US010053325B2

(12) United States Patent
Saito

(10) Patent No.: US 10,053,325 B2
(45) Date of Patent: Aug. 21, 2018

(54) APPARATUS FOR PERFORMING BINDING PROCESSING ON SHEETS AND POST-PROCESSING APPARATUS PROVIDED WITH THE SAME

(71) Applicant: Takashi Saito, Yamanashi-ken (JP)

(72) Inventor: Takashi Saito, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 191 days.

(21) Appl. No.: 14/743,435

(22) Filed: Jun. 18, 2015

(65) Prior Publication Data

US 2015/0368062 A1 Dec. 24, 2015

(30) Foreign Application Priority Data

Jun. 18, 2014 (JP) ..... 2014-125130

(51) Int. Cl.
*B31F 1/07* (2006.01)
*B65H 37/04* (2006.01)
(Continued)

(52) U.S. Cl.
CPC ..... *B65H 37/04* (2013.01); *B31F 1/07* (2013.01); *B31F 5/02* (2013.01); *B65H 9/04* (2013.01);
(Continued)

(58) Field of Classification Search
CPC ... B31F 1/07; B31F 5/02; G03G 2215/00852; B65H 31/34; B65H 9/04; B65H 9/06;
(Continued)

(56) References Cited

U.S. PATENT DOCUMENTS 5,717,843 A * 2/1998 Tabata et al. ..... 358/1.18
7,300,044 B2 * 11/2007 Stemmle ..... 270/52.18
(Continued)

FOREIGN PATENT DOCUMENTS

JP 2004-155537 A 6/2004
JP 2008-268441 A 11/2008
(Continued)

OTHER PUBLICATIONS

China Patent Office, "Office Action for Chinese Patent Application No. 201510340443.X," dated Nov. 24, 2017.

*Primary Examiner* — Leslie A Nicholson, III
(74) *Attorney, Agent, or Firm* — Manabu Kanesaka

(57) ABSTRACT

To provide a sheet binding processing apparatus for enabling strong binding strength or weak binding strength to be selected in a neat sheet posture to perform binding processing in applying narrow pressure to a plurality of sheets with concavo-convex-shaped pressurizing surfaces to perform the binding processing, in positioning sheets in a binding position for press-binding the sheets with the concavo-convex-shaped pressurizing surfaces that mutually mesh to perform the binding processing, it is possible to set an engagement area of the sheets and the pressurizing surfaces in two or more different steps with positioning references or by shifting a position of a binding processing section in the direction for passing over an edge side of the sheets to perform the binding processing.

12 Claims, 11 Drawing Sheets

(51) Int. Cl.

| | |
|---|---|
| ***B65H 39/00*** | (2006.01) |
| ***B65H 9/06*** | (2006.01) |
| ***B65H 9/04*** | (2006.01) |
| ***B31F 5/02*** | (2006.01) |
| ***G03G 15/00*** | (2006.01) |
| ***B65H 31/02*** | (2006.01) |
| ***B65H 31/20*** | (2006.01) |
| ***B65H 31/34*** | (2006.01) |

(52) U.S. Cl.
CPC ..... *B65H 9/06* (2013.01); *B65H 31/02* (2013.01); *B65H 31/20* (2013.01); *B65H 31/34* (2013.01); *B65H 39/00* (2013.01); *G03G 15/6541* (2013.01); *B65H 2301/4212* (2013.01); *B65H 2301/4213* (2013.01); *B65H 2301/51616* (2013.01); *B65H 2403/41* (2013.01); *B65H 2405/114* (2013.01); *B65H 2405/1134* (2013.01); *B65H 2801/27* (2013.01); *G03G 2215/00852* (2013.01)

(58) Field of Classification Search
CPC ..... B65H 37/04; B65H 39/00; B65H 2301/51616
USPC ..... 270/58.07, 58.08, 58.11, 58.12, 58.17, 270/58.27
See application file for complete search history.

(56) References Cited

U.S. PATENT DOCUMENTS

| | | | | |
|---|---|---|---|---|
| 8,235,375 | B2 * | 8/2012 | Shiraishi | 270/58.09 |
| 8,246,033 | B2 * | 8/2012 | Sato | 270/58.09 |
| 8,333,372 | B2 * | 12/2012 | Awaya et al. | 270/58.07 |
| 8,444,133 | B2 * | 5/2013 | Kimura | 270/58.08 |
| 2012/0145340 | A1 * | 6/2012 | Middlemas et al. | 162/111 |
| 2013/0214471 | A1 * | 8/2013 | Yabe | 270/1.01 |
| 2014/0030000 | A1 * | 1/2014 | Gamo et al. | 399/408 |
| 2014/0154032 | A1 | 6/2014 | Mizuno | |
| 2014/0161565 | A1 * | 6/2014 | Obuchi et al. | 412/33 |

FOREIGN PATENT DOCUMENTS

| | | | |
|---|---|---|---|
| JP | 5253453 | B | 4/2013 |
| JP | 2013-216451 | A | 10/2013 |
| JP | 2014-73681 | A | 4/2014 |

* cited by examiner

Ce1; HIGH PRESSURIZATION FORCE
Ce2; LOW PRESSURIZATION FORCE

A; FIRST REFERENCE CURRENT VALUE (STRONG BINDING)
B; SECOND REFERENCE CURRENT VALUE (WEAK BINDING)
A > B

APPARATUS FOR PERFORMING BINDING PROCESSING ON SHEETS AND POST-PROCESSING APPARATUS PROVIDED WITH THE SAME

RELATED APPLICATIONS

The present application is based on, and claims priority from, Japanese Application No. JP2014-125130 filed Jun. 18, 2014, the disclosure of which is hereby incorporated by reference herein in its entirety.

TECHNICAL FIELD

The present invention relates to a sheet post-processing apparatus for binding a plurality of sheets, and more particularly, to improvements in a binding processing mechanism for enabling binding strength to be adjusted.

BACKGROUND OF THE INVENTION

Generally, this type of binding processing apparatus is known as an apparatus that performs binding processing on a bunch of sheets supported on a paper mount (sheet support surface) as a post-processing apparatus in an image formation system, or the like. As a binding processing mechanism, known are a mechanism (staple binding mechanism) for binding a bunch of sheets with a staple, and a mechanism (press binding mechanism) for applying narrow pressure to a bunch of sheets with pressurizing surfaces having concavo-convex surfaces to perform press binding.

The press binding mechanism for performing binding processing on a bunch of sheets without using a metal needle is selected as a method of enabling bound sheets to be easily separated and divided and not affecting the environment in discarding documents. On the other hand, such a problem is also known that the sheet peels off when a bunch thickness of a bunch of sheets to perform binding processing is thick, page turning is performed vigorously or the like.

For example, Patent Document 1 discloses a press binding mechanism, and proposes the mechanism for increasing or decreasing a press binding region corresponding to a bunch of sheets to perform binding processing. The Document discloses the mechanism that is a pressurizing mechanism in the shape of gears which rotate in a mutually meshing state in which by adjusting the rotation amount, strong binding is obtained when a band-shaped binding portion is long, and weak binding is obtained when the portion is short.

Further, Patent Document 2 discloses a configuration for enabling a strong binding finish or a weak binding finish to be selected by changing the angle direction of a press binding pressurizing region. In applying narrow pressure to sheets with a pair of pressurizing surfaces to perform press binding, the sheets are deformed in the shape of gathers. Binding easy to peel or binding hard to peel is selected by changing a mesh width (short-side direction) and mesh length (long-side direction) in the arrangement with respect to the sheet turning direction.

PRIOR ART DOCUMENT

Patent Document

[Patent Document 1] Japanese Patent Gazette No. 5253453
[Patent Document 2] Japanese Patent Application Publication No. 2014-73681

DISCLOSURE OF INVENTION

Problems to be Solved by the Invention

As the method of performing binding processing on a plurality of sheets without using a staple, such a binding processing method has already been known that narrow pressure is applied to stacked sheets from the frontside and backside directions with concavo-convex-shaped pressurizing surfaces to deform the sheets in the shape of gathers. In this binding processing methods are known the demerit that the binding strength is weak and the merit that it is possible to easily peel off during use.

Then, in such a press binding mechanism, it is attempted to select binding a bunch of sheets strongly or binding weakly to perform binding processing. For example, the mechanism as described in Patent Document 1 adopts the mechanism for applying narrow pressure to a bunch of sheets with pressurizing surfaces in the shape of mutually meshing gears, and enables a long binding length or short binding length to be selected by changing the rotation amount of the gear-shaped pressurizing surfaces.

In the mechanism for thus changing the binding length in press binding to be long or short, since the binding length of a bunch of sheets is different, in a short binding length, as shown in FIG. 11B, sheets are easy to turn in page turning, and it is difficult to neatly bind.

Further, in the mechanism for changing the press binding direction as described in Patent Document 2, as shown in FIG. 11D, since the binding length direction (long side) is positioned between the sheet corner and the image formed area, such a problem arises that the binding margin portion enters the image formed area.

It is an object of the present invention to provide a sheet binding processing apparatus for enabling strong binding strength or weak binding strength to be selected in a neat sheet posture to perform binding processing, in applying narrow pressure to a plurality of sheets with concavo-convex-shaped pressurizing surfaces to perform the binding processing.

Means for Solving the Problem

In order to attain the above-mentioned object, in the present invention, in positioning sheets in a binding position for press-binding the sheets with concavo-convex-shaped pressurizing surfaces that mutually mesh to perform binding processing, it is possible to set an engagement area of the sheets and the pressurizing surfaces in two or more different steps with positioning references or by shifting a position of a binding processing section in the direction for passing over an edge side of the sheets to perform the binding processing.

Further, the configuration will be described specifically. The apparatus is provided with a sheet support section (24) that supports a plurality of sheets, a position regulating section (26) and side edge alignment member (27) that position a sheet in a predetermined position of the sheet support section, a binding processing section (49) that performs binding processing on the sheets on the sheet support section, and a control section (50) that controls the position regulating section and binding processing section.

The above-mentioned binding processing section is comprised of a pair of pressurizing surfaces (31) (41) that apply narrow pressure to the sheets from frontside and backside directions, and a driver (DC) that causes the pressurizing surfaces to reciprocate between a waiting position separated from the sheets and an actuation position for pressurizing the sheets, and the above-mentioned pair of pressurizing surfaces are formed by arranging a plurality of tooth forms in a convex shape and a concavo shape that mutually mesh with a predetermined mesh width in a predetermined length. The above-mentioned control section is configured to shift at least one of a positioning reference of the position regulating section and a binding position of the binding processing section to a position in the direction for passing over an edge side of the sheets to perform binding processing so as to set an engagement area of the pressurizing surfaces and the sheets in two or more different steps.

Advantageous Effect of the Invention

The present invention is to relatively shift positions of the sheets and pressurizing surfaces and adjust an engagement length between the pressurizing surfaces and the sheets in the mesh width direction in performing press binding with a pair of upper and lower pressurizing surfaces, and therefore, has the following effects.

In the present invention, in applying narrow pressure to a bunch of sheets with the pressurizing surfaces having concavo-convex surfaces, the sheets are bound by forming concavo-convex-shaped gathers with a predetermined width and predetermined length in a sheet binding position. At this point, the gather width direction acts on the direction for strengthening sheet mutual binding, and the gather length direction acts on the sheets not to be skewed or turn when bending moment works on the sheet by page turning or the like.

Accordingly, it is preferable that the binding length is long to bind sheets neatly (without being skewed), and that the binding width is formed to be short to make sheets easy to separate. In contrast thereto, in the conventional method in Patent Document 1, the binding length is formed to be short to make sheets easy to separate, and therefore, a bunch of binding-processed sheets is skewed and is a disorder posture by page turning or the like.

In the present invention, a bunch of sheets undergoes binding processing with a beforehand set predetermined binding length, and at this point, the binding width is made a wide width for strong binding, while being made a narrow width for weak binding. Therefore, it is possible to obtain desired binding strength, and the posture of the bunch of sheets is not disturbed by page turning or the like.

Further, in the present invention, it is possible to select the wide binding width or short binding width by changing (position adjustment) a reference position of the section to position sheets in a binding position, or changing (position adjustment) a binding position of the binding processing section, and therefore, it is possible to adjust the binding strength with simplified structure.

BRIEF DESCRIPTION OF DRAWINGS

FIG. 4A illustrates a position relationship between pressurizing surfaces and sheets, FIGS. 4B and 4C illustrate states in which the sheets are press-bound with the pressurizing surfaces, and FIG. 4D illustrates a cross-sectional state of a bunch of sheets subjected to press binding processing;

FIG. 5A illustrates a waiting state, FIG. 5B illustrates a pressurization state, and FIG. 5C is an explanatory view of the control configuration;

FIG. 6A is an explanatory view of a state of shifting the sheet end regulating member between the first reference and the second reference, FIG. 6B illustrates a state in which sheets positioned in the first reference are subjected to the binding processing, FIG. 6C illustrates a state in which sheets positioned in the second reference are subjected to the binding processing, and FIG. 6D illustrates a drive mechanism for shifting a position of the sheet end regulating member between the first reference and the second reference;

FIG. 7A illustrates a state of shifting a side edge alignment member in different first reference and second reference, FIG. 7B illustrates a state in which sheets positioned in the first reference are subjected to the binding processing, FIG. 7C illustrates a state in which sheets positioned in the second reference are subjected to the binding processing, and FIG. 7D illustrates a drive mechanism for shifting a position of the side edge alignment member between the first reference and the second reference;

FIG. 8A illustrates a state in which a press binding section is positioned in a first reference with respect to sheets to perform binding processing, FIG. 8B illustrates a state in which the section is positioned in a second reference, FIG. 8C illustrates a state of sheets bound with the binding section positioned in the first reference, FIG. 8D illustrates a state of sheets bound with the binding section positioned in the second reference, and FIG. 8E illustrates a drive mechanism for shifting a position of the binding processing unit;

FIG. 11A shows the case where a press binding length is made long, FIG. 11B shows the case where the press binding length is made short, FIG. 11C shows the case where the press binding direction is set at a 45-degree sheet corner, and FIG. 11D shows the case where the press binding direction is set at a 135-degree sheet corner.

BEST MODE FOR CARRYING OUT THE INVENTION

Figure 1:
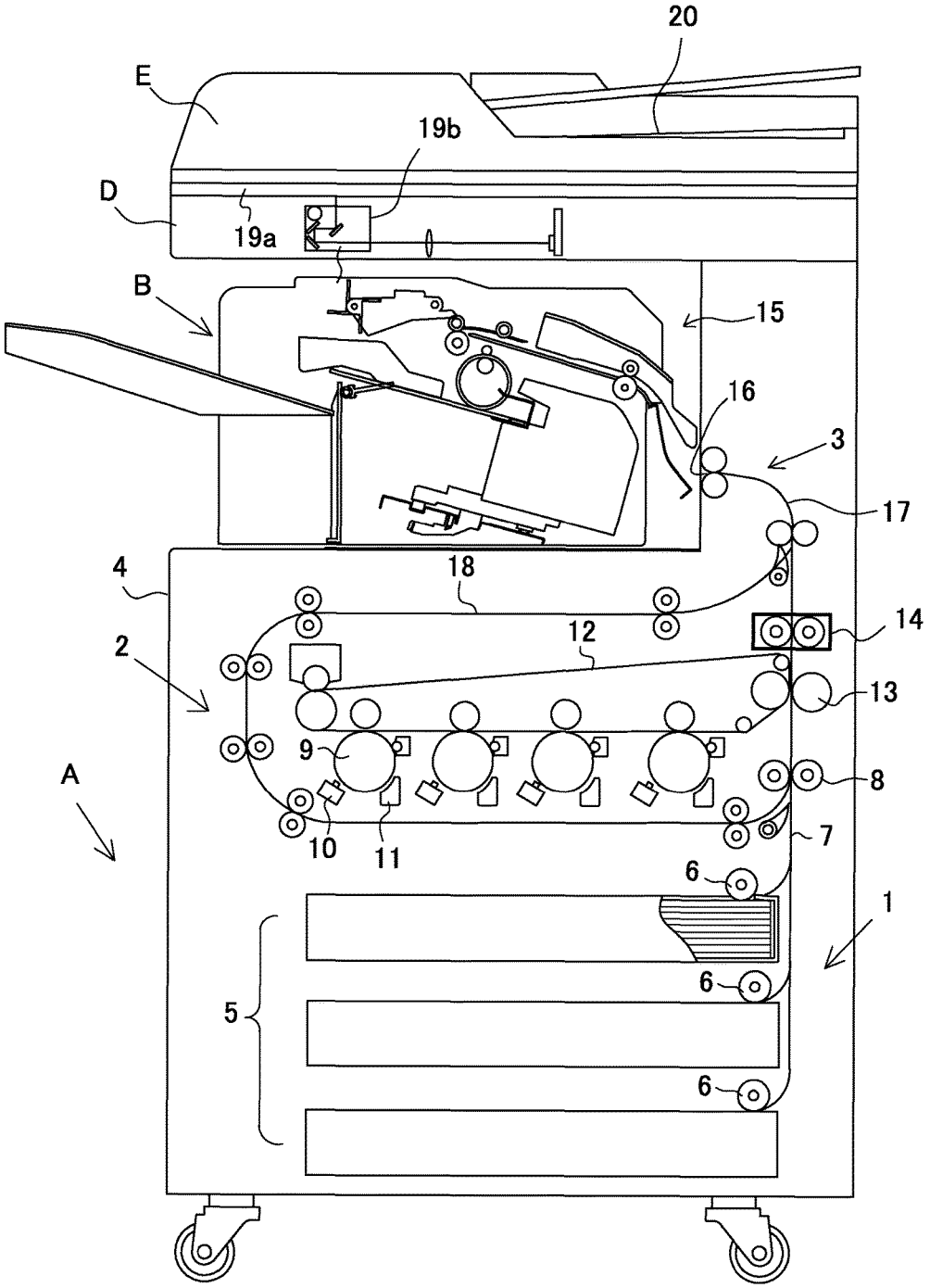
FIG. 1 is an explanatory view of an entire configuration of an image formation system provided with a post-processing apparatus according to the present invention.

The present invention will specifically be described below based on Embodiments as shown in drawings. FIG. 1 shows an image formation system according to the invention, and the system is comprised of an image formation apparatus A that forms an image on a sheet, and a post-processing apparatus B that performs post-processing such as binding processing on image-formed sheets to store. A sheet binding apparatus C that performs binding processing on collected sheets is incorporated into the post-processing apparatus B as an optional unit.

[Image Formation System]

The image formation system as shown in FIG. 1 will be described. The image formation system as shown in the figure is comprised of the image formation apparatus A and post-processing apparatus B, and the sheet binding processing C is incorporated into the post-processing apparatus. The image formation apparatus will be described below.

The image formation apparatus A is comprised of a paper feed section 1, image formation section 2, sheet discharge section 3 and signal processing section (not shown), and is incorporated into an apparatus housing 4. The paper feed section 1 is comprised of a plurality of cassettes 5 that stores sheets, and is configured to be able to store sheets of different sizes. Into each of the cassettes 5 are incorporated a paper feed roller 6 that feeds out the sheet, and a separation section (separation hook, separation roller, etc.; not shown) for separating sheets on a sheet-by-sheet basis.

Further, the paper feed section 1 is provided with a paper feed path 7 to feed a sheet from each cassette 5 to the image formation section 2. A register roller pair 8 is provided at the path end of the paper feed path 7 to align the front end of the sheet fed from each cassette 5, while causing the sheet to wait until the sheet is fed corresponding to image formation timing of the image formation section 2.

As the image formation section 2, it is possible to adopt various image formation mechanisms that form an image on a sheet. The section as shown in the figure indicates an electrostatic type image formation mechanism. As shown in FIG. 1, a plurality of drums 9 each comprised of a photoconductor is disposed in the apparatus housing 4 corresponding to color components. In each of the drums 9 are disposed an emitter (laser head or the like) 10 and developing device 11. Then, the emitter 10 forms a latent image (electrostatic image) on each drum 9, and the developing device 11 adds toner ink. The ink image added onto each drum is transferred to a transfer belt 12 for each color component, and the image is synthesized.

The transfer image formed on the belt is transferred to the sheet fed from the paper feed section 1 by a charger 13, is fused by a fuser (heat roller) 14, and then is fed to the sheet discharge section 3. The sheet discharge section 3 is comprised of a sheet discharge outlet 16 formed in the apparatus housing 4 to carry out the sheet to sheet discharge space 15, and a sheet transport path 17 to guide the sheet from the image formation section 2 to the sheet discharge outlet. In addition, a duplex path 18, described later, is connected to the sheet discharge section 3 to reverse the side of the sheet with the image formed on the frontside so as to feed again to the image formation section 2.

"D" shown in the figure denotes an image read unit, and is comprised of a platen 19*a*, and a read carriage 19*b* that reciprocates along the platen. "E" shown in the figure denotes an original document feed unit, and is comprised of a transport mechanism which feeds original document sheets set on a paper feed tray to the platen 19*a* on a sheet-by-sheet basis and stores on a sheet discharge tray 20 after reading the image.

[Post-Processing Apparatus]

Figure 2:
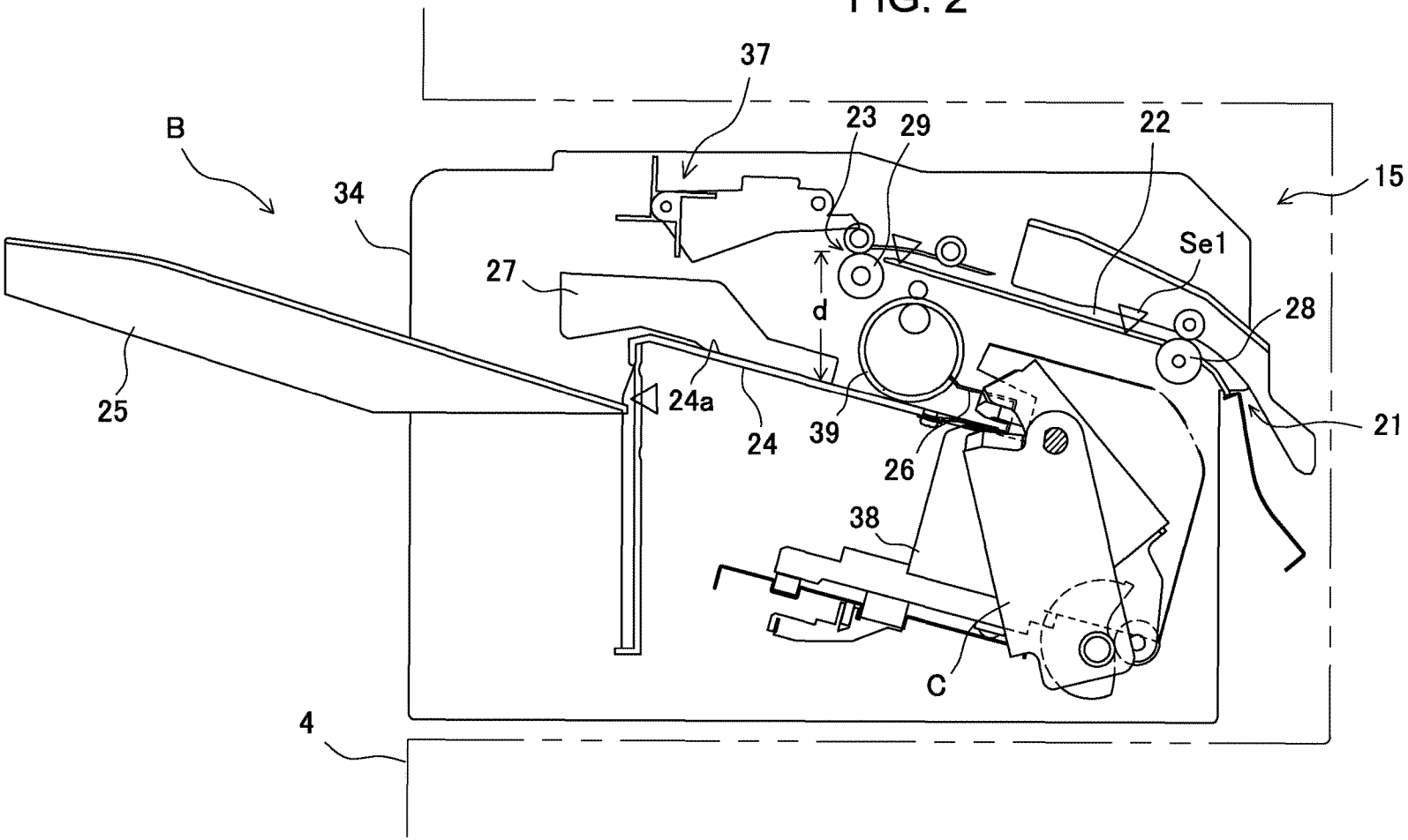
FIG. 2 is a detailed explanatory view of the post-processing apparatus in the image formation system of FIG. 1.

The post-processing apparatus B as shown in FIGS. 1 and 2 will be described next. The post-processing apparatus B as shown in the figure includes the built-in binding unit C (sheet binding apparatus; the same in the following description), and is configured as a terminal apparatus of the image formation system.

In FIG. 2, the post-processing apparatus B is comprised of an apparatus housing 34, a sheet transport path 22 disposed in the housing, a processing tray 24 (sheet support section; the same in the following description) disposed on the downstream side of a sheet discharge outlet 23 of the path, and a stack tray 25 disposed on the downstream side of the tray 24.

In the processing tray 24 are disposed a carry-in section 37 that carries a sheet in, and a position regulating section (sheet end regulating member 26 and side edge alignment member 27 described later) that positions the carried-in sheet in a predetermined post-processing position (binding position) P. In the processing tray 24 is disposed the sheet binding apparatus (press binding section 49) that performs binding processing on a bunch of sheets. The configuration of the press binding section 49 will be described later. Together with the press binding section 49, in the processing tray 24 shown in the figure is disposed a staple binding section 38 that performs binding processing on sheets. Sheets collected on the tray undergo press binding or staple binding with the designated section.

As shown in FIG. 2, in the apparatus housing 34 is disposed the sheet transport path 22 having a carry-in entrance 21 and sheet discharge outlet 23, and the path shown in the figure is configured to receive a sheet in the horizontal direction, and transport in an approximately horizontal direction to carry out of the sheet discharge outlet 23. Into the sheet transport path 22 is incorporated a transport mechanism (transport roller and the like) that transports the sheet.

The above-mentioned transport mechanism is comprised of transport roller pairs at predetermined intervals corresponding to the path length, a carry-in roller pair 28 is disposed near the carry-in entrance 21, and a sheet discharge roller pair 29 is disposed near the sheet discharge outlet 23. The carry-in roller pair 28 and sheet discharge roller pair 29 are coupled to the same drive motor (not shown), and transport a sheet at the same velocity. Further, in the sheet transport path 22 is disposed a sheet sensor Se1 that detects at least one of the front end and rear end of the sheet.

On the downstream side of the sheet discharge outlet 23 of the sheet transport path 22, the processing tray 24 is disposed while forming a level difference d. In order to collect sheets fed from the sheet discharge outlet 23 upward to collect in the shape of a bunch, the processing tray 24 is provided with a paper mount surface 24*a* that supports at least a part of sheets. The processing tray 24 is configured to collect sheets fed from the sheet discharge outlet 23 in the shape of a bunch, align in a predetermined posture, then perform binding processing, and carry out the processed bunch of sheets to the stack tray 25 on the downstream side.

A sheet carry-in section 37 (paddle rotating body) is disposed in the sheet discharge outlet 23, and transports the sheet to a predetermined position on the processing tray 24. Further, in the processing tray 24 is disposed a take-in transport section 39 that guides the sheet front end to the sheet end regulating member 26.

The take-in transport section 39 is disposed on the upstream side of the sheet end regulating member 26, and the section shown in the figure is comprised of a belt member in the shape of a ring. The belt member 39 engages in the uppermost sheet on the paper mount surface, and rotates in a direction for transporting the sheet toward the sheet end regulating member (position regulating member) 26.

The sheet end regulating member 26 that positions the sheet is provided in the front end portion (rear end portion in the sheet discharge direction in the tray as shown in the figure) of the processing tray 24. Then, the member strikes the sheet, which is carried in from the sheet discharge outlet 23 with the take-in transport section 39, to regulate. The sheet end regulating member 26 aligns sheets collected on the processing tray in a predetermined processing position.

Further, in the processing tray 24 is disposed the side edge alignment member 27 that positions the width direction of the sheet positioned with the sheet end regulating member 26 in a reference line. The side edge alignment member 27 shown in the figure aligns the width of the sheet, which is fed from the sheet discharge outlet 23 and positioned with the sheet end regulating member 26, in a sheet-discharge orthogonal direction. The side edge alignment member 27 is comprised of a pair of right and left alignment plates, and positions the sheet in a predetermined reference line (center reference or side reference). The member as shown in the figure shows the case of setting in the center reference to position the sheet width direction with reference to the sheet front end.

The sheet end regulating member 26 is disposed fixedly or movably in position with respect to the processing tray 24. In Embodiments 2 and 3 described later, the sheet end regulating member 26 is disposed in the processing tray fixedly. In Embodiment 1, the sheet end regulating member 26 is attached to the processing tray 24 movably in position. Then, in Embodiments 2 and 3, sheets carried onto the processing tray are positioned in a predetermined binding processing position P. In Embodiment 1, sheets carried onto the processing tray are determined in any position of the first reference position Sp1 and the second reference position Sp2 by instructions of an operator or conditions of sheet size or the like.

As shown in FIGS. 6A to 6D, the side edge alignment member 27 is comprised of a pair of right and left alignment plates 27*a*, 27*b*, alignment motors M1 that shift one or both of the plates in an approach direction or separate direction, and a transmission mechanism 56 (apparatus shown in figure, rack-and-pinion mechanism). Then, when right and left alignment motors M1 are rotated in synchronization with each other, a pair of right and left alignment members 27*a*, 27*b* are shifted in the approach direction or separate direction by the same amount.

As operation of the right and left alignment plates 27*a*, 27*b*, the plate reciprocates between a waiting position set corresponding to a sheet size, and an actuation position that coincides with the sheet size. Therefore, the alignment plates 27*a*, 27*b* are provided with a position sensor and shift amount control section, and the position is controlled by controlling a rotation amount of the alignment motor M1 with reference to a detection signal of the home position sensor.

In the shift amount control section shown in figure, the alignment motor M1 is comprised of a stepping motor, and the rotation amount is controlled by controlling (for example, PWM control) pulse currents to supply to the motor. In addition thereto, an encoder and encoder sensor that detect the rotation amount may be disposed in the transmission mechanism to control the rotation amount of the transmission shaft.

Then, in the case of performing side-edge alignment with reference to the sheet center, based on the sheet size information, the right and left alignment motors M1 are rotated to shift to the reference positions Sp, and then, the right and left alignment plates (side edge alignment member) 27 are shifted to the waiting positions Wp. The waiting positions Wp are set for a distance larger than the width size of the sheet, and at timing at which the sheet is carried onto the processing tray, the positions of the right and left alignment members 27*a*, 27*b* are shifted from the waiting positions Wp to alignment positions Ap. Then, the sheet carried onto the processing tray is aligned so that the sheet center coincides with the reference position Sp.

In such a configuration, in Embodiment 2 as described later, it is controlled to enable the alignment reference of the side edge alignment member 27 to be set at the first or second different position Sp1 or Sp2. Then, for each sheet size, it is made possible to set (select) the positioning reference at the first reference position Sp1 or second reference position Sp2. Further, in the other Embodiments (1, 3) as described later, for each sheet size, the positioning reference is set (at a certain value) in advance. In addition, the configuration of the side edge end regulating member 27 will be described later according to FIGS. 6A to 6D.

In the processing tray 24 is disposed the press binding section 49 and staple binding section 38 that perform binding processing on sheets which are struck by the sheet end regulating member 26 to regulate and are positioned in the width direction by the side edge alignment member 27. The sheet binding processing mechanism and binding processing operation by the staple binding section 38 has already been known well, and therefore, the description thereof is omitted.

[Press Binding Section]

The press binding section (sheet binding apparatus) 49 according to the present invention will be described according to FIG. 3. The press binding section 49 pressurizes and deforms a plurality of sheets collected in the shape of a bunch to mesh with one another to bind. Therefore, the press binding section 49 is comprised of a cramp mechanism that cramps a plurality of sheets to deform.

The mechanism is comprised of a pair of pressurizing surfaces 31, 41 for applying narrow pressure to bunch-shaped sheets from the frontside and backside directions, a pair of pressurizing members 30, 40 respectively provided with the pressurizing surfaces, and a drive mechanism (driver) PM that shifts the pressurizing surface of one of the pressurizing members from a waiting position (non-pressurization position; the same in the following description) separated from the sheets to a pressurization position for pressurizing the sheets. The cramp mechanism of FIG. 3 is comprised of the fixed-side pressurizing member 30 having the pressurizing surface 31 on the fixed side, the movable-side pressurizing member 40 having the pressurizing surface 41 on the movable side, and the drive mechanism PM that shifts the movable-side pressurizing surface from the waiting position separated from the sheets to the pressurization position for pressurizing the sheets.

The fixed-side pressurizing member 30 (hereinafter, referred to as "fixed member") and movable-side pressurizing member 40 (hereinafter, referred to as "movable member") are configured to cramp a bunch of sheets supported on the pressurizing surface 31 (hereinafter, referred to as "fixed surface") of the fixed member 30 with the pressurizing surface 41 (hereinafter, referred to as "movable surface") of the movable member 40. Therefore, the movable member 40 is axially supported to be swingable on a shaft 42 as the center, and the shaft 42 is fixed to the fixed member 30. The shaft 42 may be fixed to another member such as a unit frame, instead of being limited to the fixed member 30.

Further, the fixed member 30 is integrally fixed to the unit frame 46. Then, by operation that the movable member 40 performs swing motion on the shaft 42 as the center, the fixed surface 31 and movable surface are shifted to positions between a pressurization state (pressurization position) for cramping a bunch of sheets and a non-pressurization state (waiting position) separated from the bunch of sheets.

In the apparatus as shown in FIG. 1, the fixed member 30 is formed of a frame member (metal, reinforced resin or the like) in the shape of a "U" (channel shape) in cross section, and the movable member 40 is supported between its side walls 30*a*, 30*b* swingably by the shaft 42. Thus, the movable member 40 is guided by the side walls 30*a*, 30*b* of the fixed member 30 and performs swing motion on the shaft 42 as the center. Then, in the movable member 40 is disposed a return spring 43 for biasing to the waiting position side. The return spring 43 is disposed between the member 40 and the unit frame 46 (or the fixed member 30).

At least one of the fixed surface 31 and movable surface 41 is comprised of a concavo-convex surface (protrusion-groove) to deform the pressurized sheets. In the surfaces as shown in the figure, each of the fixed surface 31 and the movable surface 41 is formed of the concavo-convex surface, and the shape is configured so that pluralities of arranged convex portions and concavo portions mesh with one another substantially at the same time. In consideration of the shape (particularly, edge shape) that does not provide sheets with damage in pressurizing, the shape of each of the concavo-convex surfaces is configured in an optimal shape such that overlapped sheets concurrently mesh with one another to deform. Then, deformation in the shape of gathers (shape of waves) is left in the sheets narrow-pressed with the concavo-convex surfaces, and overlapped sheets are bound.

The drive mechanism of the above-mentioned movable member 40 will be described. The movable member 40 supported swingably by the fixed member 30 is comprised of the movable surface 41 at the front end portion and a cam follower 44 (hereinafter, referred to as "follower roller") at the base end portion with the shaft 42 as a boundary. The movable surface 41 at the front end and follower roller 44 are formed in a lever length such that action (booster mechanism) of a lever works through the shaft 42.

Further, a cam member 33 (in the apparatus shown in the figure, cylindrical cam) is disposed at the base end portion of the fixed member 30. The cam member 33 is supported by a cam shaft 32, the cam shaft 32 is axially supported by the fixed member 30 rotatably, and the cam member 33 and follower roller 44 are disposed in the position relationship that the member and roller are mutually engaged. Further, rotation of the drive motor DC is transferred to the camshaft 32 via a transmission section 35, and coupling is made so that the cam member 33 rotates forward and backward by forward and backward rotation of the drive motor.

Figure 3:
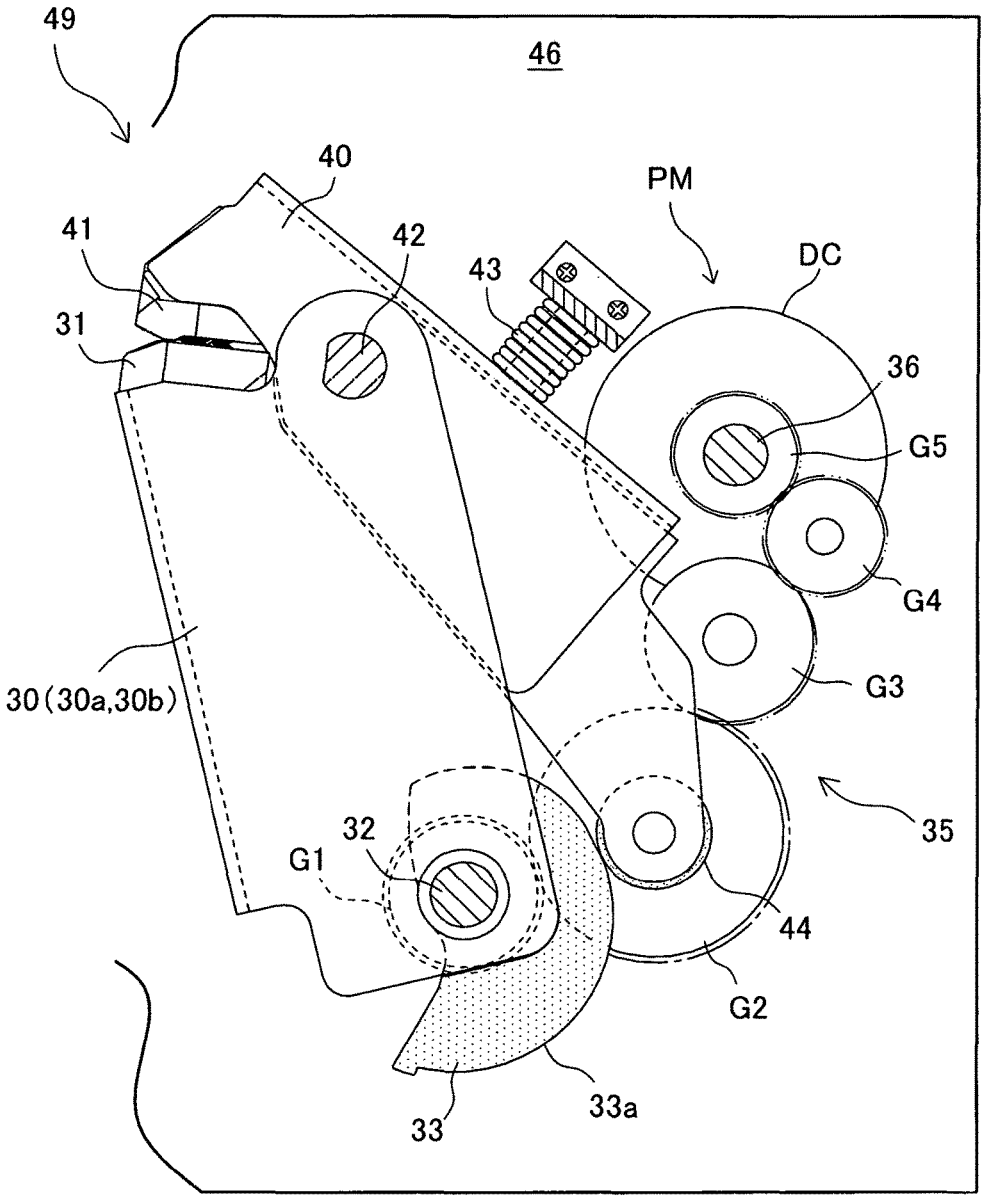
FIG. 3 is a mechanism explanatory view of a sheet binding processing unit (press binding unit) incorporated into the post-processing apparatus of FIG. 2.

As shown in FIG. 3, the drive motor DC is mounted on the unit frame 46, and rotation of a drive shaft 36 thereof is transferred to the cam shaft 32 via transmission gears G2, G3, G4, G5 constituting the transmission section 35. The cam member 33 rotates in a counterclockwise direction as viewed in FIG. 3 by the gear G1 coupled to the cam shaft 32. In the apparatus as shown in the figure, the cam member 33 is configured to repeat counterclockwise rotation (CCW) and clockwise rotation (CW) in a predetermined angle range by forward and backward rotation of the drive motor DC. Then, a cam surface 33*a* of the cam member 33 causes the follower roller 44 and movable member 40 integral with the roller 44 to perform swing motion on the shaft 42 as the center.

In the drive mechanism of FIG. 3, when the drive motor DC is rotated in a counterclockwise direction, the movable member 40 swings in a counterclockwise direction on the shaft 42 as the center, and the movable surface 41 shifts from the waiting position Wp to the pressurization position Ap. Further, a non-engagement portion is formed on the cam surface 33*a*, and in this position, the movable member 40 is biased to the waiting position Wp by action of the return spring 43 without undergoing action of the cam surface 33*a*.

Then, the drive motor DC is rotated in a clockwise direction and is halted in a position in which the non-engagement portion cps of the cam surface 33*a* and follower roller 44 are engaged in each other. Then, by the spring force of the return spring 43, the movable surface 41 shifts from the pressurization position Ap to the waiting position Wp, and is halted in this position.

Figure 5A:
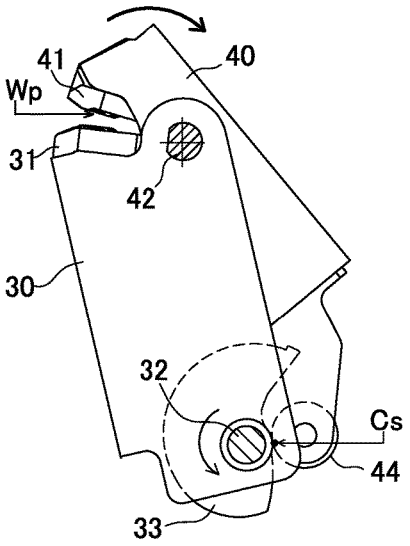
FIGS. 5A to 5C contain explanatory views of a control configuration for adjusting a pressurization force in binding processing operation in Embodiments 1, 2 and 3, where
Figure 5B:
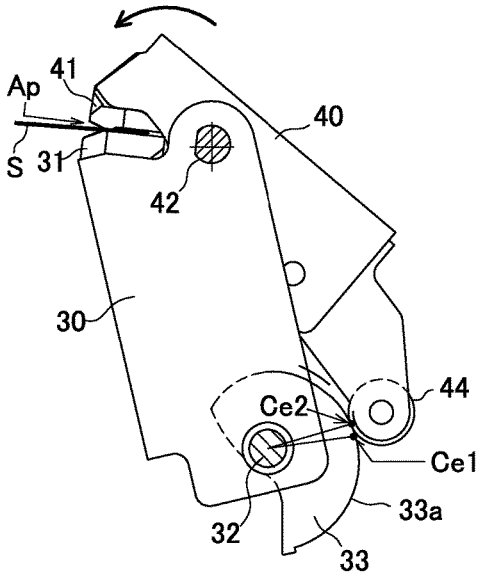

In "Cs" position as shown in FIG. 5A, the cam surface 33*a* holds the movable surface 41 in the waiting position Wp, without acting the swing force on the follower roller 44. Further, in "Ce" position as shown in FIG. 5B, the cam surface 33*a* provides the follower roller 44 with an action force such that the movable member 40 swings in a counterclockwise direction. Near this Ce2 position (which differs according to the thickness of a bunch of sheets), the movable surface 41 starts pressurization on the sheets. Then, in "Ce1", although the position differs according to a bunch thickness of a bunch of sheets, the maximum pressurization force is acted upon the sheets S in this position, and pressurization operation is finished. Subsequently, by clockwise rotation of the cam member 33, the surface performs return operation in the order of "Ce1", "Ce2" and "Cs".

Then, the cam surface 33*a* is formed in the shape of a "helicoil" such that the pressurization force gradually increases between the initial position (Cs) in which the movable surface 41 pressurizes a bunch of sheets S and the pressurization finish position (Ce). This is because of acting almost the same pressurization force even when the thickness of the bunch of sheets is different between the fixed surface 31 and the movable surface 41.

[Pressurization Force Adjustment of the Pressurizing Surfaces]

Described next is sheet binding processing operation by the press binding section 49 as described above. The press binding section 49 disposed on the processing tray 24 waits, with a state in which a pair of upper and lower pressurizing surfaces 31, 41 are separated from each other as shown in FIG. 5A as a home position, in the position. In this waiting position Wp, a sheet is carried onto the processing tray 24, a plurality of sheets is positioned by the position regulating section 26, and side edge alignment member 27 to be loaded and collected, and bunch-shaped sheets are set in between a pair of pressurizing surfaces 31, 41.

The pair of pressurizing surfaces 31, 41 are supported by the pressurizing members (fixed-side pressurizing member 30 and movable-side pressurizing member 40), and shift from the waiting position Wp where the surfaces are separated from each other to the actuation position Ap (actuation state of FIG. 5B). At this point, the bunch of sheets is pressurized by the pair of pressurizing surfaces 31, 41, and the sheets are mutually deformed, and at the same, are pressed to be bound. The binding among the sheets is due to the fact that fiber components among sheets become mutually entangled and that plastic deformation occurs in the concavo-convex shape in the overlapped state. Accordingly, as the engagement area of the pressurizing surfaces 31, 41 and the sheets increase, the binding force increases.

Figure 4A:
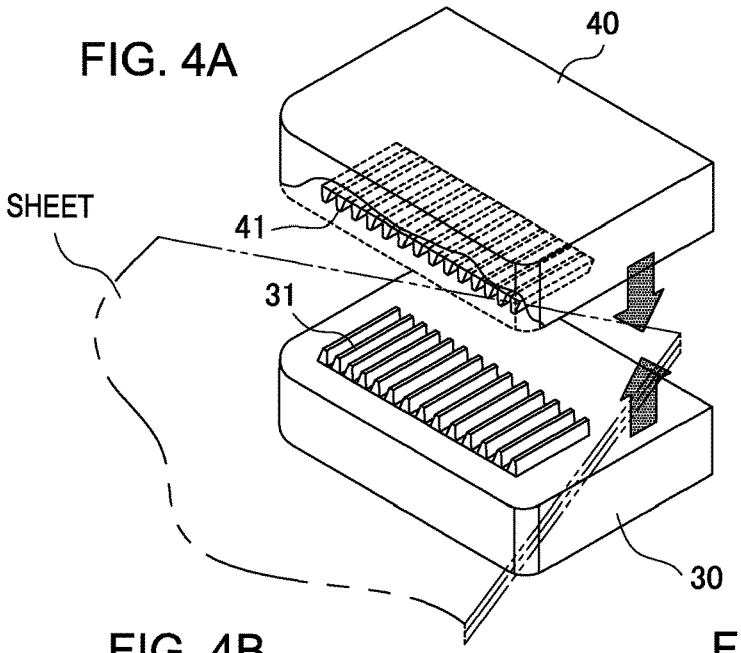
FIGS. 4A to 4D contain explanatory views of states of press-binding a bunch of sheets in the binding processing unit of FIG. 3, where

In the pressurizing surfaces 31, 41 as shown in the figure, pluralities of concavities and convexities are formed with a predetermined length (binding length; L) and predetermined width (binding width; W) at predetermined angles (angle $\alpha$, angle $\beta$) with respect to the sheet corner in the state of FIG. 4A. In the present invention, by adjusting at least one of the binding length L and the binding width W, the binding force is adjusted. Hereinafter, in the present invention, the "binding length L" is assumed to be the entire length dimension of a plurality of consecutive concavo-convex tooth forms, and the "binding width W" is assumed to be the width dimension of each of the concavo-convex tooth forms.

Described next is the pressurization force of the pressurizing surfaces 31, 41 on sheets. The movable-side pressurizing member 40 applies narrow pressure to sheets to perform binding processing when the member 40 rotates from the waiting position of FIG. 5A to the actuation position of FIG. 5B. Therefore, the movable-side pressurizing member 40 is provided with the cam member 33, and by controlling rotation of the drive motor DC coupled to the cam, reciprocates between the waiting position Wp and the actuation position Ap.

Figure 5C:
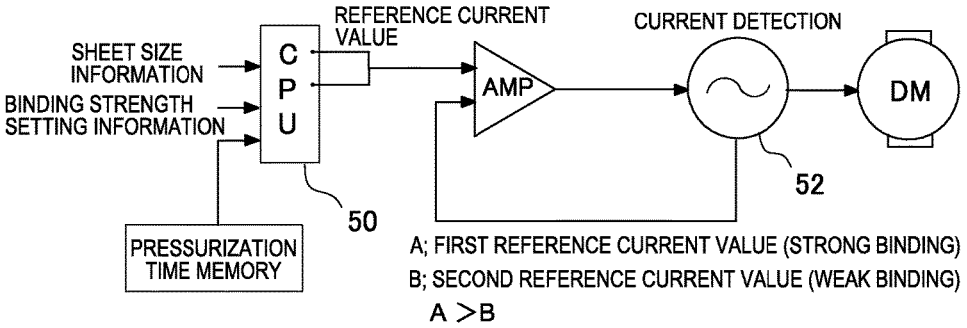

At this point, a control section 50 described later adjusts the level of the pressurization force acted on the pressurizing surfaces 31, 41 by controlling the rotation angle (Ce1 and Ce2 in FIG. 5B) of the cam member 33. The control configuration will be described according to FIG. 5C.

The drive motor DC as shown in the figure is comprised of a direct-current motor, and by adjusting a current value to supply to a motor driver 51, the control section 50 adjusts the pressurization force. Two-step pressurization force adjustments shown in the figure will be described. When "strong binding" is set by mode setting of an operator, the control section 50 sets a current value to supply to the drive motor DC at "A (>B)" amperes. On the other hand, when "weak binding" is set by an operator, the control section 50 sets a supply current value at "B(<A)" amperes. These current values were beforehand set by experiments and stored in a storage section (RAM 54 or the like).

Then, the control section 50 reads the pressurization force Fp (load torque) and pressurization time Tp which were beforehand set and stored in the storage section (RAM) 54. Then, when the operator sets at "strong binding", the section 50 reads the current value A from the RAM 54. Similarly, when the operator sets at "weak binding", the section 50 reads the current value B from the RAM 54.

Then, the control section 50 compares the reference current value (A or B) that corresponds to the pressurization force Fp designated by the operator with a detection value from a current detection section (circuit) 52 that detects the back electromotive force of the drive motor DC, and controls so as to supply a set current value to the motor. By this control, the drive motor DC continues rotation until the current value reaches the predetermined reference current value (A, B), and is halted when the torque acted upon the motor reaches a predetermined value. At this point, the cam member 33 is halted at the rotation angle Ce1 (current value A; strong binding) as shown in FIG. 5B, or the rotation angle Ce1 (current value B; weak binding).

[Pressurization Time]

The control section 50 sets the pressurization time Tp corresponding to a state of a bunch of sheets to perform binding processing. This is because of needing the time for pressurizing to cause plastic deformation in the sheets in pressurizing and deforming a plurality of sheets to bind so that the sheets mesh with one another. When the pressurization time Tp is set to be long, the sheets are deformed so as to mesh with one another reliably, and the meshed state is maintained. When the pressurization time Tp is short, the sheets are not deformed until the mesh, or are restored to the original shape.

Then, the control section 50 as shown in the figure is configured to set the pressurization time according to at least one condition of (1) bunch thickness, (2) the number of sheets and (3) sheet material of sheets to perform binding processing. This is because when the sheet bunch is thick, the deformation amount of sheets decreases in proportion to the thickness (due to the effect of the volume amount of sheets to deform), and when the number of sheets is high, the deformation amount of the sheets decreases in proportion to the number of sheets (due to the effect of an air layer between sheets). The description of the specific configuration thereof is omitted.

Described next is control of the drive motor DC that rotates the cam member 33 of the pressurizing member 30 as described previously. The drive motor DC is coupled to the cam member 33, the cam member 33 is rotated by rotation of the motor, and the movable-side pressurizing member 40 provided with the cam follower 44 swings at a predetermined angle on the shaft 42 as the center. By this operation, the movable-side pressurizing surface 41 (movable surface) shifts from the waiting position Wp to the actuation position Ap, and presses the fixed-side pressurizing surface 31 to contact.

[Engagement Area Adjustment of the Pressurizing Surfaces and Sheets]

Figure 4B:
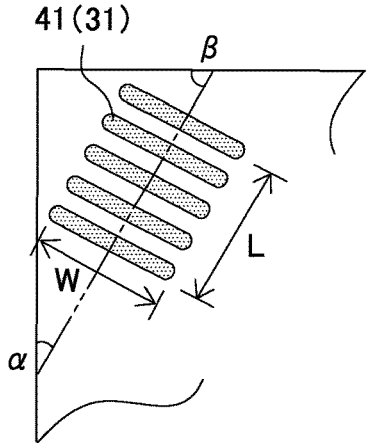
Figure 4C:
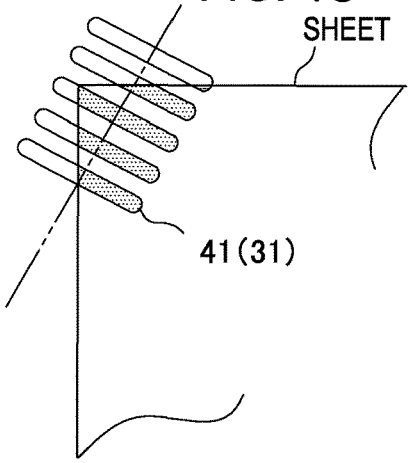
Figure 4D:
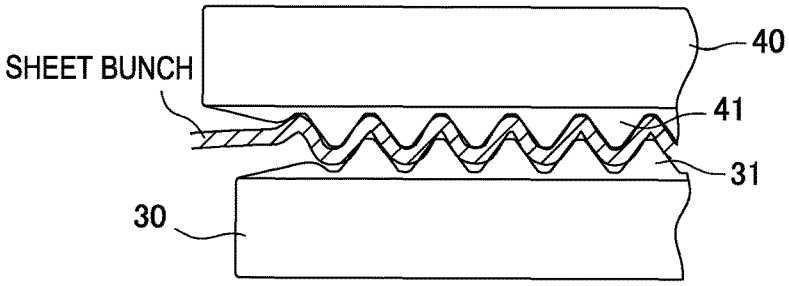

In the present invention, in the case of enabling the binding strength of a bunch of sheets to be adjusted in applying narrow pressure to the bunch of sheets with a pair of pressurizing surfaces to perform binding processing in the above-mentioned press binding mechanism, it is a feature that the relative position relationship between the sheet bunch and the pressurizing surface is made the engagement relationship (strong binding; state of FIG. 4B) that the entire pressurizing surface is positioned on the inner side, and the engagement relationship (weak binding; state of FIG. 4C) that a part of the pressurizing surface is positioned on the outer side, with the edge side of the sheet as a boundary.

Therefore, the positioning regulating section 26, and side edge alignment member 27 that position sheets on the processing tray 24 (sheet support section) are configured to be able to shift to positions between the first reference Sp1 for strong binding and the second reference Sp2 for weak binding in two or more steps. Embodiment 1 described later shows the case of configuring to enable the positioning reference by the sheet end regulating member 26 to be set by selecting the first or the second. Further, Embodiment 2 shows the case of configuring to enable the positioning reference by the side edge regulating member 27 to be set by selecting the first or the second.

Embodiment 1

Embodiment 1 will be described according to FIGS. 6A to 6D. The post-processing apparatus B as described previously is provided with the positioning reference (Sp) to position sheets in a predetermined processing position (binding position) P in collecting the sheets on the processing tray 24, and the binding processing section 49 is disposed to perform the binding processing on the sheets positioned in the reference.

Figure 6A:
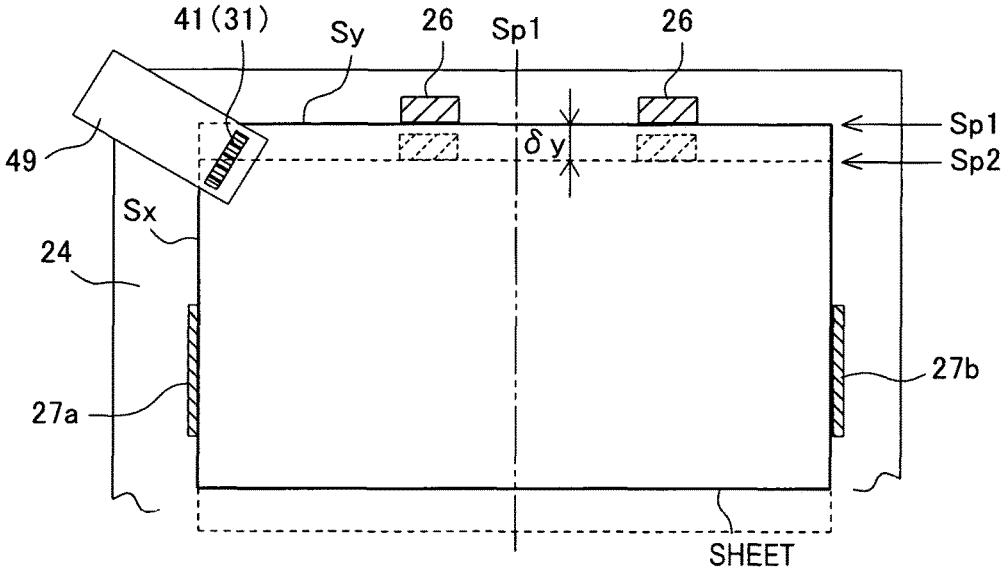
FIGS. 6A to 6D show Embodiment 1 of a positioning mechanism for sheets to perform binding processing, which is an Embodiment for collecting sheets on a processing tray with a sheet end regulating member in first reference and second reference that are different positions, where

In Embodiment 1 as shown in the figure, as the positioning reference Sp, it is configured to enable the sheet regulating position of the sheet end regulating member 26 to be selected from between reference 1 (Sp1) and reference 2 (Sp2). Therefore, as shown in FIG. 6D, the sheet end regulating member (striking stopper) 26 is supported on the bottom of the processing tray 24 to be able to shift (slidably) in the sheet carry-in direction (vertical direction as viewed in the figure). The sheet end regulating member 26 is configured to be able to shift a sheet regulating surface 26*x* of the regulating member to positions between the reference 1 (Sp1) and the reference 2 (Sp2) with a shift motor SM and transmission mechanism (rack and pinion) 55.

The sheet end regulating member 26 is disposed in a plurality of portions at predetermined intervals in the sheet width direction, and the portions and interval are set as appropriate. Then, by controlling a rotation amount of the shift motor SM, the sheet end regulating member 26 is positioned in one of the first reference Sp1 and the second reference Sp2. FIG. 6A illustrates the position relationship between the sheets positioned in the first reference Sp1 and the binding processing section 49, and the position relationship between the sheets positioned in the second reference Sp2 and the binding processing section 49.

Figure 6B:
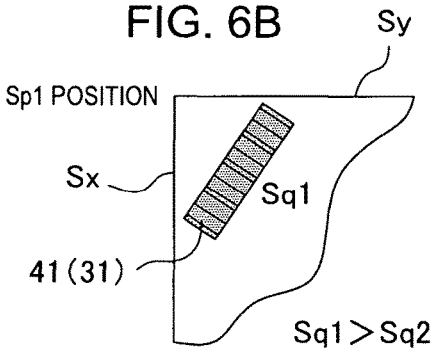

As can be seen from FIG. 6B, in the sheets positioned in the first reference Sp1, the entire pressurizing surfaces 31, 41 are positioned on the inner side than the edge sides (Sx, Sy) of the sheets. In contrast thereto, in the sheets positioned in the second reference Sp2, a part of the pressurizing surfaces 31, 41 are positioned on the outer side of the edge side (Sy) of the sheets, and the remaining part of the pressurizing surfaces are positioned on the inner side of the edge side (Sy) (see FIG. 6C). Accordingly, an engagement area (Sq) of the pressurizing surfaces 31, 41 and sheets is a wide area Sq1 in the first reference Sp1, and is a narrow area Sq2 in the second reference Sp2. As a result, the binding force of the sheets is made proportional to the engagement area, the wide area Sq1 makes the strong binding force, and the narrow area Sq2 makes the weak binding force.

Thus, as the set positions of the first reference Sp1 and second reference Sp2, for positioned sheets, a distance by is set so that the pressurizing surfaces 31, 41 are positioned on the inner side of the sheet edge sides in the first reference Sp1, and are positioned (positioned while bridging) across the outer side and inner side of the sheet edge side in the second reference. The distance δy is set at a different value (distance) corresponding to the sheet size, or set at a certain value irrespective of the size. Usually, the distance δy is set in a range of several millimeters to several tens of millimeters.

Figure 6C:
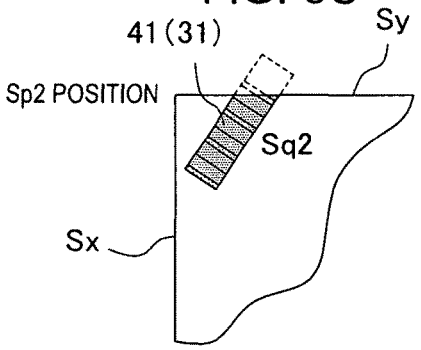
Figure 6D:
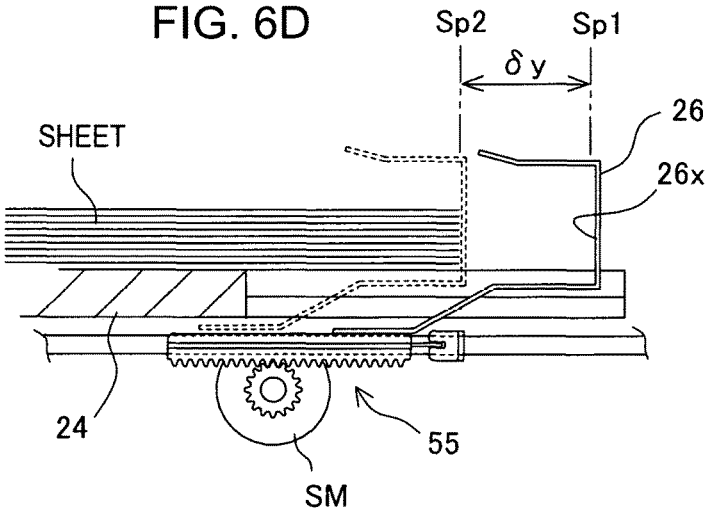

Then, in the sheets subjected to the binding processing with the binding processing section 49, a pair of pressurizing surfaces 31, 41 apply narrow pressure to the sheets with the engagement area Sq1 as shown in FIG. 6B in the first reference Sp1, and with the engagement area Sq2 as shown in FIG. 6C in the second reference Sp2. The binding strength among the sheets at this point is strong binding by the wide engagement area Sq1 in the first reference Sp1, and is weak binding of the narrow engagement area Sq2 in the second reference Sp2. The binding strength at this point is proportional (when the pressurization force is constant) to the engagement area Sq of the pressurizing surfaces 31, 41 and sheets. The binding processing operation for a bunch of sheets in Embodiment 1 will be described later.

Embodiment 2

Embodiment 2 as shown in FIGS. 7A to 7D will be described. As the regulating section to position sheets on the processing tray 24, the Embodiment shown in the figure shows the case of "enabling the pair of right and left side edge regulating members 27 to shift to positions between the first reference Cp1 and the second reference Cp1".

Described is the case of positioning sheets in a processing position in the center reference as shown in the figure. The pair of right and left side edge regulating members 27 are supported on the processing tray 24 to be able to shift in the width direction. In the member 27 shown in the figure, each of side edge regulating members 27*a*, 27*b* is fitted slidably into a guide groove (not shown) disposed on the bottom of the processing tray 24. In each of the side edge regulating members 27*a*, 27*b* are disposed the alignment motor M1 (in the members shown in the figure, a pair of right and left drive motors), and the transmission mechanism 56 (rack-and-pinion mechanism, belt-and-pulley mechanism, interlocking lever mechanism or the like).

In such a configuration, the control section 50 rotates the right and left alignment motors M1, and shifts a pair of right and left side edge regulating members 27 from home positions Hp to waiting positions Wp, and after sheets are carried onto the tray, shifts from the waiting positions Wp to alignment positions Ap. By reciprocating motion (alignment operation) of the side edge regulating members 27, sheets are aligned in the reference position on the tray. At this point, the control section 50 performs alignment operation on the right and left regulating members 27*a*, 27*b* with the first reference Cp1 as the center or the second reference Cp2 as the reference.

Thus, as the set positions of the first reference Cp1 and second reference Cp2, for positioned sheets, a distance δx is set so that the pressurizing surfaces 31, 41 are positioned on the inner side of the sheet edge sides in the first reference Cp1, and are positioned (positioned while bridging) across the outer side and inner side of the sheet edge side in the second reference Cp2. The distance δx is set at a different value (distance) corresponding to the sheet size, or set at a certain value irrespective of the size. Usually, the distance δx is set in a range of several millimeters to several tens of millimeters.

Figure 7A:
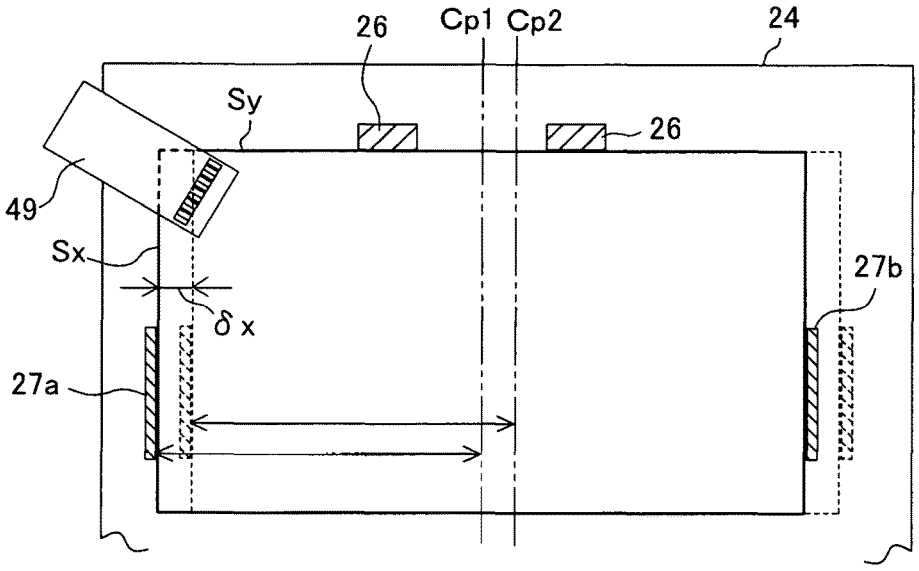
FIGS. 7A to 7D show Embodiment 2 of the positioning mechanism for sheets to perform binding processing, where
Figure 7B:
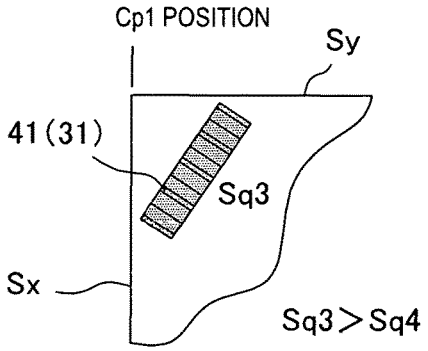
Figure 7C:
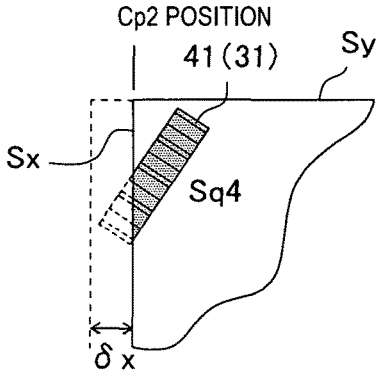
Figure 7D:
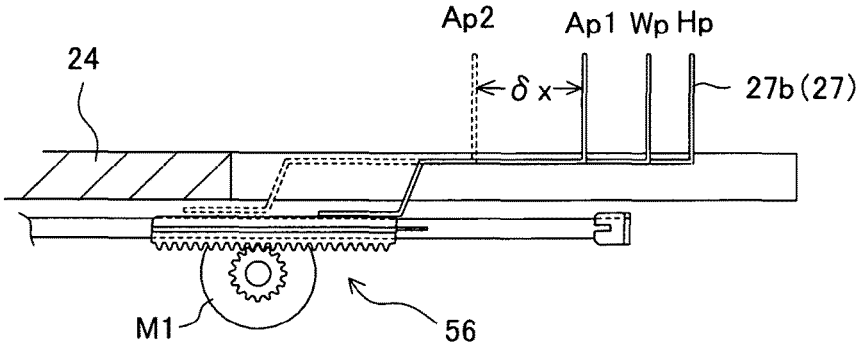

Then, in the sheets subjected to the binding processing with the binding processing section C, a pair of pressurizing surfaces 31, 41 apply narrow pressure to the sheets with the engagement area Sq3 as shown in FIG. 7B in the first reference Cp1, and with the engagement area Sq4 as shown in FIG. 7C in the second reference Cp2. The binding strength among the sheets at this point is strong binding by the wide engagement area in the first reference Cp1, and is weak binding of the narrow engagement area in the second reference Cp1. The binding strength at this point is proportional (when the pressurization force is constant) to the engagement area of the pressurizing surfaces and sheets.

Embodiment 3

The Embodiment as shown in FIGS. 8A to 8E will be described. In the processing tray 24 are disposed the sheet end regulating member 26 that regulates the end edge of the sheet, and the side edge regulating member 27 that regulates sheet side edges, and the regulating section 26, and side edge alignment member 27 is fixed to a predetermined position without making a position adjustment to the reference position of regulating operation.

Figure 8A:
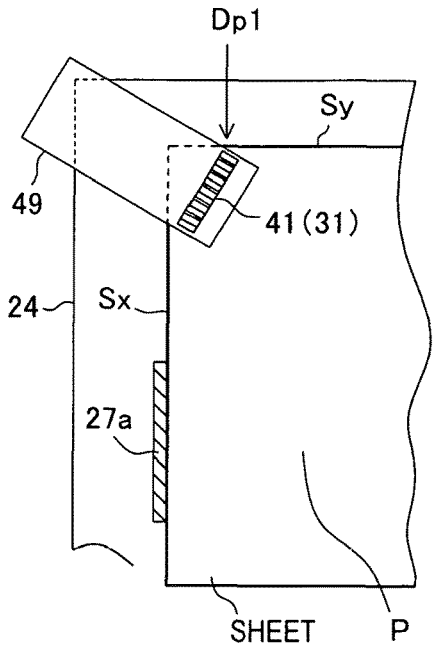
FIGS. 8A to 8E show Embodiment 3 according to the present invention, where
Figure 8B:
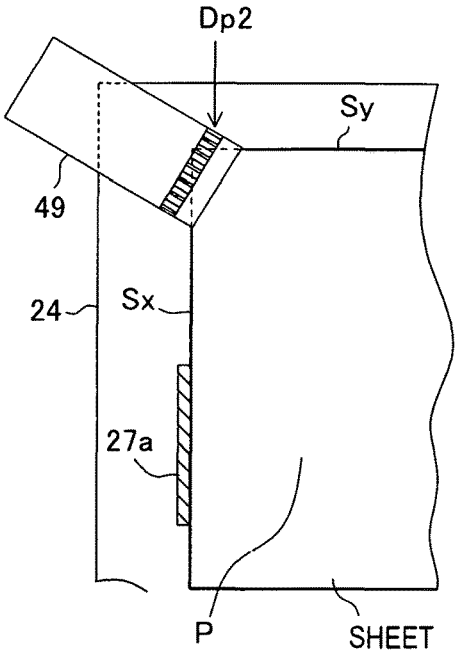
Figure 8C:
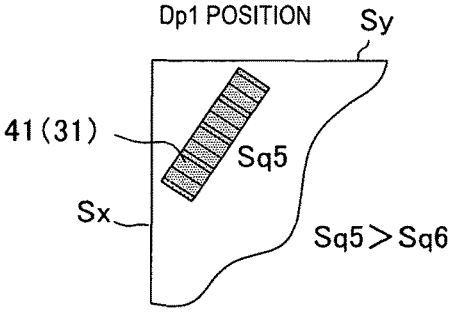
Figure 8D:
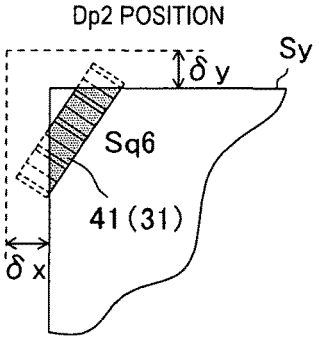
Figure 8E:
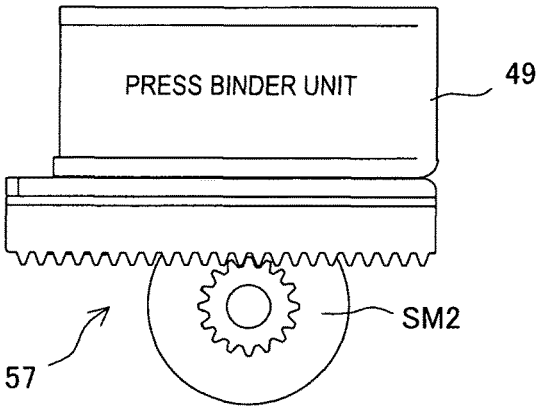

Then, the binding processing section 49 is attached to the apparatus frame (not shown) to be able to shift to positions, and as shown in FIG. 8E, is comprised of a shift motor SM2 and transmission mechanism 57 (rack-and-pinion mechanism, belt-and-pulley mechanism, or the like), and in a state in which the binding position is the first reference Dp1 (FIG. 8A) or the second reference Dp2 (FIG. 8B), the pressurizing surfaces 31, 41 are configured to be able to shift to positions with respect to the sheets on the processing tray.

As the set positions of the first reference Dp1 and second reference Dp2, for positioned sheets, distances (δX) (δy) are set so that the pressurizing surfaces 31, 41 are positioned on the inner side of the sheet edge sides in the first reference Dp1, and are positioned (positioned while bridging) across the outer side and inner side of the sheet edge side in the second reference Dp2. The distance is set at a different value (distance) corresponding to the sheet size, or set at a certain value irrespective of the size. Usually, the distance is set in a range of several millimeters to several tens of millimeters.

Then, in the sheets subjected to the binding processing with the binding processing section 49, a pair of pressurizing surfaces 31, 41 apply narrow pressure to the sheets with the engagement area Sq5 as shown in FIG. 8C in the first reference Dp1, and with the engagement area Sq6 as shown in FIG. 8D in the second reference Dp2. The binding strength among the sheets at this point is strong binding by the wide engagement area in the first reference Dp1, and is weak binding of the narrow engagement area in the second reference Dp2. The binding strength at this point is proportional (when the pressurization force is constant) to the engagement area of the pressurizing surfaces and sheets.

[Control Configuration]

Figure 9:
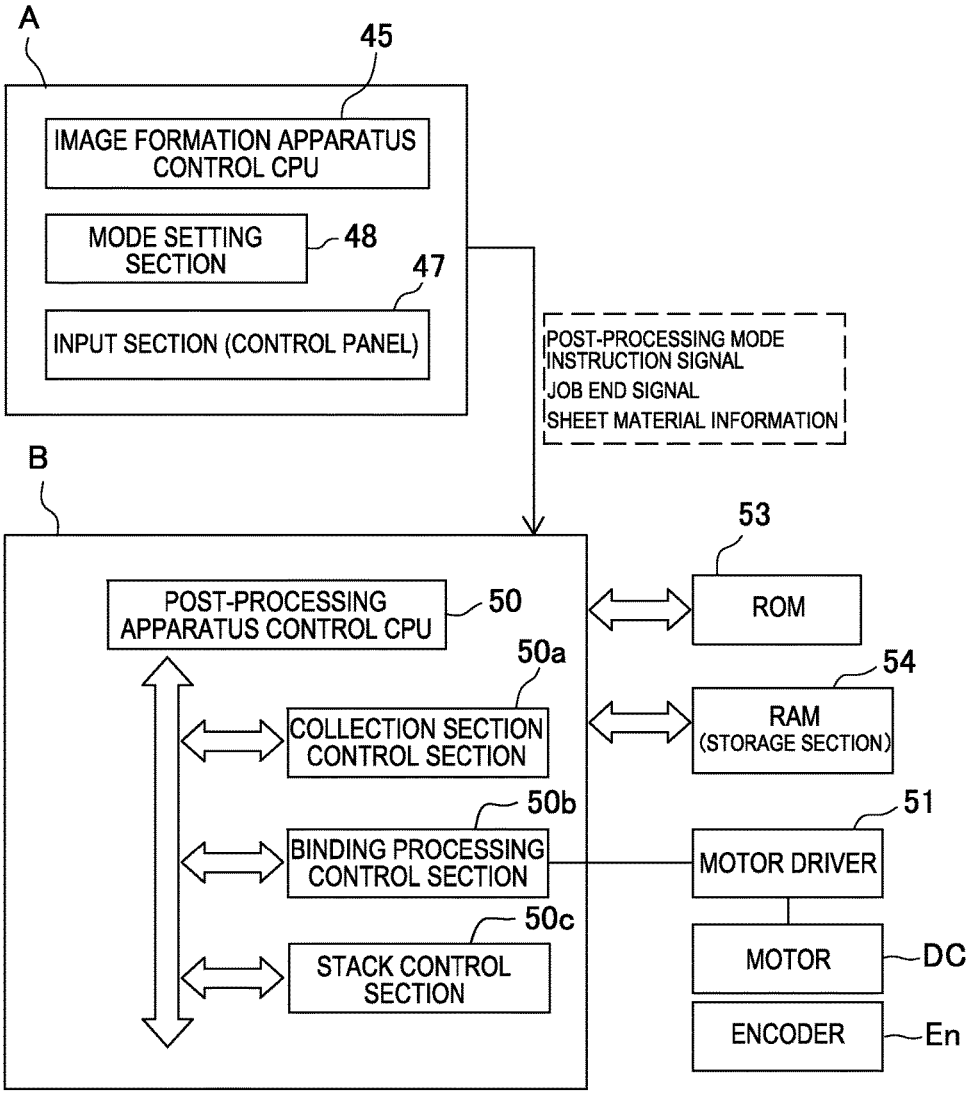
FIG. 9 is an explanatory view of a control configuration in the image formation system of FIG. 1.

Described next is a control configuration of the image formation system as shown in FIG. 1. The control section 50 as shown in FIG. 9 is comprised of an image formation control section 45 that controls the image formation unit, and the post-processing control section 50. The image formation control section 45 is comprised of a mode selecting section 48 and input section 47. The input section 47 sets image formation conditions, and at the same time, sets a binding processing mode. The binding processing mode is to select executing the binding processing with the first binding section (staple binding section) 38 or executing the binding processing with the second binding section (press binding section) 49.

The post-processing control section 50 is comprised of a post-processing control CPU, and reads execution programs stored in ROM 53 to execute post-processing operation. Further, the RAM 54 stores control data such as the pressurization time Tp of the binding operation by the second binding section 49 as described previously.

The control CPU 50 is comprised of a collection control section 50*a*, binding processing control section 50*b*, and stack control section 50*c*. The collection control section 50*a* collates and collects sheets fed from the image formation apparatus A on the processing tray 24. The binding processing control section 50*b* controls the stapler binding section 38 to perform the binding operation when the first binding processing mode is selected. On the other hand, when the second binding processing mode is selected, the section 50 controls the press binding section 49 to perform the binding operation.

At this point, when the press binding processing mode is selected, the control section 50 changes the sheet processing position on the processing tray or shifts the position of the binding processing unit 49, corresponding to the binding processing strength set by the operator, for example, "book-binding (strong binding)" or "simple binding (weak binding)".

[Binding Processing Operation]

Figure 10:
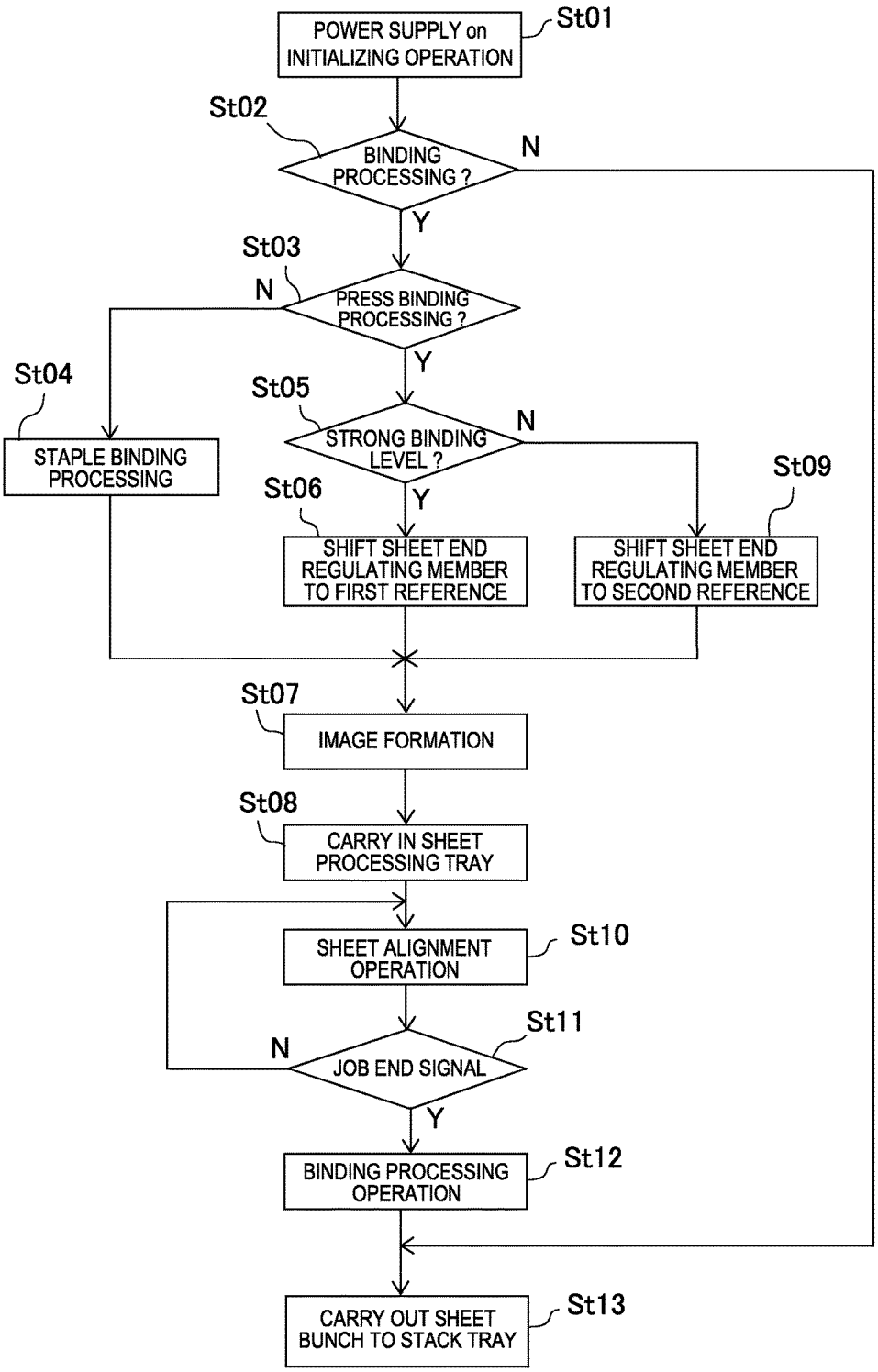
FIG. 10 is a flowchart illustrating a procedure of binding processing operation in Embodiment 1.
Figure 11A:
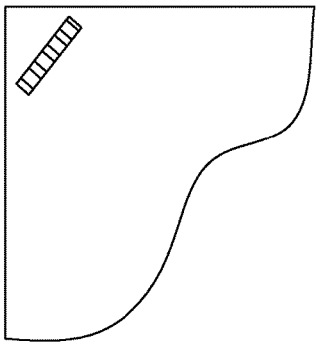
FIGS. 11A to 11D contain explanatory views of binding processing states of a bunch of sheets in a conventional press binding mechanism, where
Figure 11B:
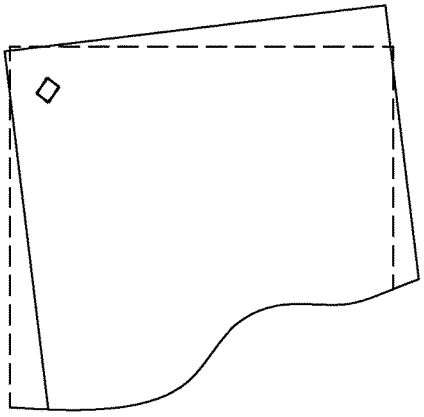
Figure 11C:
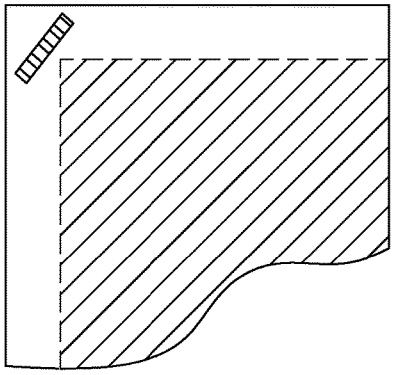
Figure 11D:
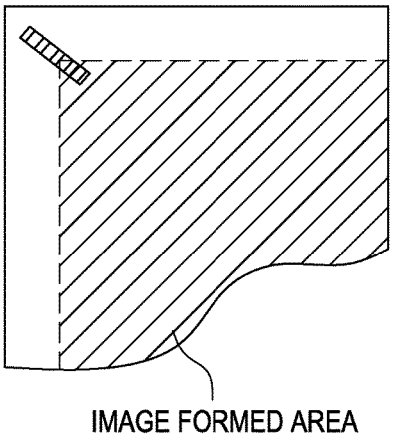

Described is a control flow of the post-processing operation as shown in FIG. 10. When the apparatus power supply is turned ON, the control section 50 executes initializing operation (St01). By this operation, the control section 50 positions the pressurizing members 30, 40 in the waiting position Wp, and (1) in Embodiment 1, shifts the sheet end regulating member 26 to the home position (first reference; Sp 1). This position is detected with the home position sensor. (2) In Embodiment 2, the control section 50 shifts the side edge regulating member 27 to the home position (first reference; Cp1). Further, (3) in Embodiment 3, the section 50 shifts the binding processing section 49 to the home position (first reference; Dp1).

Next, the control section 50 waits for mode setting of the operator (St02). In the system of FIG. 1, the binding processing mode is set at any of the press binding mode, staple binding mode and print out mode. When the staple binding mode and print out mode are selected, although the description thereof is omitted, the section 50 executes the respective processing operation (St04).

When the press binding processing is selected in the above-mentioned setting (St03), the control section 50 determines whether or not the processing is "strong binding" designation or "weak binding" designation (St05). In the "strong binding" designation, the section 50 shifts the sheet end regulating member 26 to the first reference Sp1 (when the member is already in the first reference, rests in the position) (St06). Then, the image formation apparatus A on the upstream side forms an image (St07), and the post-processing apparatus B carries the sheet in the sheet transport path 22. This sheet is carried (St08) in the processing tray 24 from the transport path 22 to the downstream side.

In the "weak binding" designation in the above-mentioned determination, the control section 50 shifts the sheet end regulating member 26 to the second reference Sp2 (St09). Then, the image formation apparatus A on the upstream side forms an image (St07), and the post-processing apparatus B carries the sheet in the sheet transport path 22. This sheet is carried in the processing tray 24 on the downstream side from the transport path 22 (St08).

The sheet, which is thus fed from the transport path 22 and is positioned in the first reference or second reference on the processing tray, is aligned with the side edge regulating member 27 so that the posture in the width direction is positioned in a predetermined reference (St10). Then, the control section 50 receives a job end signal of image formation from the image formation apparatus (St11). Subsequently, the control section 50 issues a binding operation instruction signal to the binding processing section 49. Upon receiving the signal, the binding processing section 49 executes the binding processing operation (St12). Next, the control section 50 transports a bunch of sheets subjected to the binding processing from the processing tray 24 to the stack tray 25 on the downstream side to store (St13).

In addition, in the present invention, the case is described where the press binding unit (section) 49 performs press-binding with the "wide area" in the "strong binding", while performing press-binding with the "narrow area" in the "weak binding" by designation of the operator, but one of "wide area press-binding" and "weak binding" may be set automatically corresponding to a bunch thickness of sheets or a sheet size. Further, the invention is not limited to the case of changing the press-binding area in two steps, and it is also possible to set a different press-binding area in three or more steps or in a non-step manner.

The invention claimed is:

1. A sheet binding processing apparatus comprising:

a sheet support section adapted to support a plurality of sheets;

a pressurizing member having a pair of pressurizing surfaces adapted to apply pressure to the plurality of sheets from front side and backside directions to perform binding process to the plurality of sheets on the sheet support section;

a driver to cause at least one of the pressurizing surfaces to shift between a waiting position separated from the plurality of sheets and an actuation position for applying the pressure with a predetermined pressurization force to perform the binding process to the plurality of sheets;

a pressurizing surface changing section adapted to move the plurality of sheets relative to the pressurizing surfaces in the actuation position to change an area in which the pressurizing surfaces apply the pressure to the plurality of sheets when performing the binding process; and a control section for controlling the driver to adjust the pressurization force according to the change of the area by the pressurizing surface changing section.

2. The sheet binding processing apparatus according to claim 1, wherein the pressurizing surfaces are formed with a plurality of concave-convex tooth forms.

3. The sheet binding processing apparatus according to claim 1, wherein the pressurizing surface changing section is adapted to move the plurality of sheets relative to the pressurizing surfaces in the actuation position between a first position in which the pressurizing surfaces extend across inner and outer sides of the plurality of sheets and sandwich at least one of side edges of the plurality of sheets to apply the pressure to the plurality of sheets, and a second position in which the entirety of the pressurizing surfaces applies the pressure to the inner side of the side edges of the plurality of sheets and the area in which the pressurizing surfaces apply the pressure to the plurality of sheets is greater than that of the first position.

4. The sheet binding processing apparatus according to claim 3, wherein the control section controls the driver so that the pressurization force per unit area for applying the pressure to the plurality of sheets is constant at the second position.

5. The sheet binding processing apparatus according to claim 3, wherein the control section controls the driver so that the pressurization force for applying the pressure to the plurality of sheets at the second position to be greater than the pressurization force for applying the pressure to the plurality of sheets at the first position.

6. The sheet binding processing apparatus according to claim 1, wherein the pressurizing surface changing section is adapted to move the plurality of sheets relative to the pressurizing surfaces in a first position of the actuation position, in which the pressurizing surfaces extend across inner and outer sides of the plurality of sheets and sandwich at least one of side edges of the plurality of sheets to apply the pressure to the plurality of sheets, and the pressurizing surface changing section moves the plurality of sheets and the pressurizing surfaces relative to each other in the actuating position in order to differ the area in which the pressurizing surfaces apply the pressure to the plurality of sheets in the first position in which the pressurizing surfaces extend across the inner and outer sides of the plurality of sheets and sandwich the at least one of side edges of the plurality of sheets to apply the pressure to the plurality of sheets.

7. The sheet binding processing apparatus according to claim 6, wherein the control section controls the driver so that the pressurization force per unit area for applying the pressure to the plurality of sheets is constant in the first position wherein an area in which the pressurizing surfaces apply the pressure to the plurality of sheets is different.

8. The sheet binding processing apparatus according to claim 6, wherein the control section controls the driver so that the pressurization force for applying the pressure to the plurality of sheets at a position in the first position to be greater than the pressurization force for applying the pressure to the plurality of sheets.

9. The sheet binding processing apparatus according to claim 1, further comprising:

a position regulating section adapted to position the plurality of sheets in a predetermined position of the sheet support section, wherein the position regulating section includes a side edge alignment member adapted to regulate positions of two side edges facing each other of the plurality of sheets supported on the sheet support section, and a sheet end regulating member adapted to regulate a position of at least one side edge adjacent to the two side edges of the plurality of sheets, and the pressurizing surface changing section shifts at least one of the side edge alignment member or the sheet end regulating member to move the plurality of sheets relative to the pressurizing surfaces to change the area in which the pressurizing surfaces apply the pressure to the plurality of sheets.

10. The sheet binding processing apparatus according to claim 1, further comprising:

a position regulating section adapted to position the plurality of sheets in a predetermined position of the sheet support section, wherein the position regulating section includes a first regulating member adapted to regulate a position of one of two side edges adjacent to each other of the plurality of sheets supported on the sheet support section, and a second regulating member adapted to regulate a position of the other of the two side edges of the plurality of sheets, and the pressurizing surface changing section shifts at least one of the first regulating member or the second regulating member to move the plurality of sheets relative to the pressurizing surfaces to change the area in which the pressurizing surfaces apply the pressure to the plurality of sheets.

11. The sheet binding processing apparatus according to claim 1, wherein the pressurizing surface changing section includes a shifting member for shifting the pressurizing member in a direction intersecting at least one of the side edges of the plurality of sheets supported on the sheet support section, and the pressurizing surface changing section changes the area in which the pressurizing surfaces of the pressurizing member pressurize the plurality of sheets when the shifting member shifts the pressurizing member relative to the plurality of sheets.

12. A post-processing apparatus comprising:

a processing tray adapted to load and store a plurality of sheets sequentially;

a sheet binding processing unit disposed on the processing tray; and a stack tray adapted to store the plurality of sheets carried out of the processing tray, wherein the sheet binding processing unit is the sheet binding processing apparatus according to claim 1.

* * * * *